US006559859B1

(12) United States Patent
Henry et al.

(10) Patent No.: US 6,559,859 B1
(45) Date of Patent: May 6, 2003

(54) METHOD AND APPARATUS FOR PROVIDING VIDEO SIGNALS

(75) Inventors: William T. Henry, Whitby (CA); Philip Swan, Richmond Hill (CA)

(73) Assignee: ATI International SRL, Barbados (KN)

( * ) Notice: Subject to any disclaimer, the term of this patent is extended or adjusted under 35 U.S.C. 154(b) by 0 days.

(21) Appl. No.: 09/339,886

(22) Filed: Jun. 25, 1999

(51) Int. Cl.[7] ..... G09G 5/02
(52) U.S. Cl. ..... 345/690
(58) Field of Search ..... 345/150, 214, 345/1.1, 204, 690, 2.1, 3.2, 3.3, 213, 520, 522; 348/488–491, 742, 454, 455, 456, 503, 513, 514, 525, 527, 529, 530, 531

(56) References Cited

U.S. PATENT DOCUMENTS 3,436,469 A * 4/1969 Nakazawa ..... 178/5.2
3,598,904 A * 8/1971 Foerster ..... 178/5.2 R
5,300,944 A * 4/1994 Shapiro et al. ..... 345/88
5,654,735 A * 8/1997 Nakajima ..... 345/99
5,929,924 A * 7/1999 Chen ..... 348/552
6,189,064 B1 * 2/2001 MacInnis et al. ..... 710/244

* cited by examiner

*Primary Examiner*—Matthew C. Bella
*Assistant Examiner*—G. F. Cunningham
(74) *Attorney, Agent, or Firm*—Vedder, Price, Kaufman & Kammholz

(57) ABSTRACT

A video graphics adapter is configured to provide both parallel and sequential color components to separate display monitors. When in a first state, the video graphics adapter provides individual color components to a video-output independent of each other color component, such that an entire frame of a red component will be provided to a video-out port for prior to, or subsequently after, an entire frame of the green component being provided to the video-out port. Each color component is provided to a common port. In response to a second configuration state, a traditional parallel red, green, blue (RGB) data port will be generated in order to provide data to a display device. In yet another configuration state, both the individual color components are provided at a common port, and the individual color components are provided in parallel to an RGB port.

26 Claims, 5 Drawing Sheets

METHOD AND APPARATUS FOR PROVIDING VIDEO SIGNALS

FIELD OF THE INVENTION

The present invention relates generally to providing pixel data to a display device, and more specifically to providing pixel data sequentially to a display device.

BACKGROUND OF THE INVENTION

Video graphic display devices are known in the art. Generally, the prior art display devices receive graphic components, such as red, green, and blue (RGB) color, in parallel from a graphics adapter. The color component information received by the display device is displayed substantially simultaneously by the display device. One drawback of the standard display device is the cost associated with receiving and displaying the three color component signals simultaneously. For example, a CRT needs three scanning systems to display Red, Green, and Blue pixels simultaneously. A typical color panel needs three times as many pixel elements as well as Red, Green and Blue masks for these pixel elements. Display devices capable of receiving and displaying single color components sequentially have been suggested by recent developments in display technology. These systems economize on the simultaneous multiple component hardware, and are still able to produce multi-component pixels. Typically this is done by running at a higher speed, or refresh rate, and time multiplexing the display of the Red, Green, and Blue color components. Such technology is not entirely compatible with current video display driver technologies.

Therefore, a method and system for providing color components sequentially that make use of existing display driver technology would be desirable.

DETAILED DESCRIPTION OF THE DRAWINGS

In a specific embodiment of the present invention, a graphics adapter is configured to provide both parallel and sequential graphics components to separate display monitors. When providing sequential components, the graphics adapter provides individual graphic components one at a time to a common output. For example, an entire frame of a red graphics component will be provided to the common output port prior to an entire frame of the green graphics component being provided to the common output port. The individual video components are selected from a representation of a plurality of the components. In response to a second configuration state, traditional parallel graphics signaling, (i.e. red, green, blue (RGB), composite, or YUV) will be used in order to provide data to a display device. In yet another configuration state, both the sequential and parallel graphics components are provided to separate ports. Note that the term port generally refers to one or more nodes that may or may not be associated with a connector. In one embodiment, a port would include a connector to which a display device was connected, in another embodiment, the port would include a plurality of nodes internal nodes where video signals were provided prior to being received by a display device. Such a plurality of nodes may be integrated onto the display device. The term "nodes" generally refers to a conductor that receives a signal.

Figure 1:
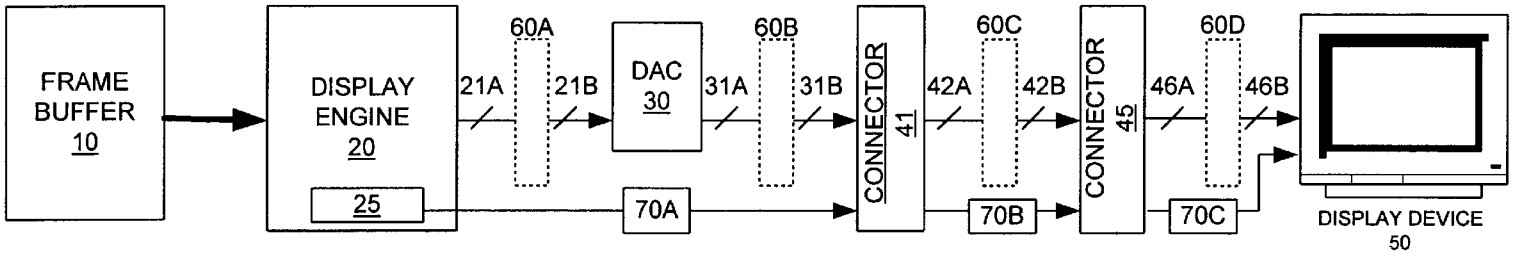
FIG. 1 illustrates, in block diagram form, a graphics system that provides a display device with the pixel and control information.
Figure 2:
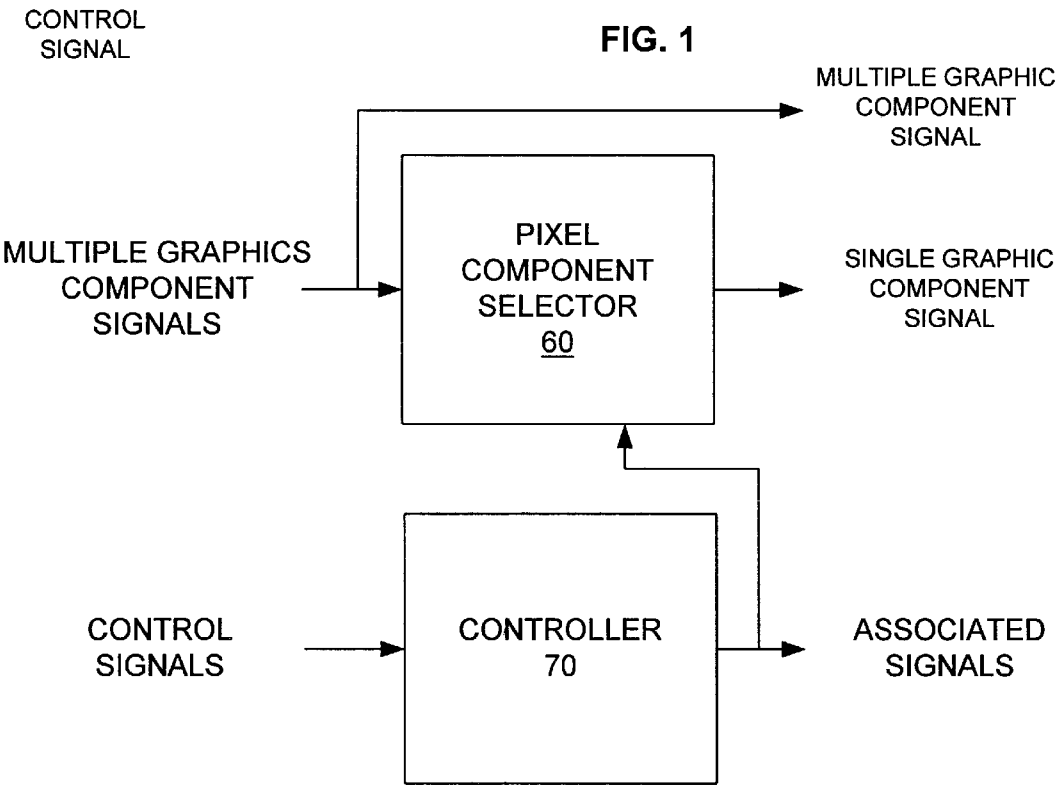
FIG. 2 illustrates, in block diagram form, a portion of the system of FIG. 1.

FIG. 1 illustrates in block diagram form a graphics system in accordance with the present invention. The system of FIG. 1 includes a Frame Buffer 10, Display Engine 20, Digital to Analog Converter (DAC) 30, Connectors 41 and 45, and a Display Device 50. In addition, a Pixel Component Selector 60, as shown in FIG. 2, can be coupled between any of a number of the components of FIG. 1. Possible Pixel Component Selector 60 locations are represented as elements 60A–D in FIG. 1. Generally, however, only one of the Pixel Component Selector locations 60A–D will be occupied in a given system. Therefore, between two components will generally be a single common node, unless the Pixel Component Selector 60 resides between the components. For example, node 21 will connect the Display engine 20 to the DAC 30, unless the Pixel Component Selector 60 exists at the position 60A. If a location is occupied, the node pair may be a common node. For example, if the Pixel Component Selector 60 only taps the signal, the node pair will be a common node. When the Pixel Component Selector 60 receives the Multiple Component Signal, the Single Graphic Component Signal can be provided at the output node, however, no signal need be provided.

In operation, Frame Buffer 10 stores pixel data to be viewed on the display device 50. The pixel data is accessed via a bus by the Display Engine 20. The Display Engine 20 is a multiple component pixel generator in that it provides a plurality of graphics components for each pixel DAC 30. In one embodiment, the graphics components will be a plurality of separate signals, such as RGB or YUV data signal. In other embodiments, the graphics components can be one signal representing a plurality of components, such as a composite signal of the type associated with standard television video. In the embodiment shown, the plurality graphics components from the Display Engine 20 are provided to the DAC 30. The DAC 30 converts the plurality of digital graphics components to analog representations (analog graphics components) which are outputted and received at connectors, or ports, 41 and 45 respectively. The signal is ultimately displayed by the Display Device.

Control Signals, or other information relating to the graphics components is provided from the Display Engine 20. A Controller 70 may reside at one of the locations 70A or 70B.

In accordance with FIG. 1, multiple graphics components are received at each of nodes 21, 31, 42, and 46, unless the Pixel Component Generator 60A–D is present. If a Pixel Component Generator 60 is present at one of the locations 60A–D, the signal at respective node portions 21B, 31B, 42B, or 46B may be different than the signal received by the Pixel Component Generator 60A–60D.

FIG. 2 illustrates the Pixel Component Selector 60 for receiving the signal labeled Multiple Graphics Component Signal. The Multiple Graphics Component Signal represents the signal or signals received by the Pixel Component Selector 60 when in one of the locations 60A–60B of FIG. 1. For example, the signal provided by the Display Engine 20 to node 21A is the Multiple Graphics Component Signal. Likewise, the signal received at the connector 45 is a Multiple Graphics Component Signals provided the Multiple Graphics Component Signal was not substituted earlier. As illustrated in FIG. 2, the Pixel Component Selector 60 provides a Single Graphic Component Signal, and can optionally provide the Multiple Graphics Component Signals to the next device of FIG. 1, such as from connector 41 to connector 45.

Depending upon the specific implementation, the Single Graphic Component Signal can be substituted for the Multiple Graphics Component Signals in the flow of FIG. 1. For example, Pixel Component Selector 60 receives the Multiple Graphics Component Signal from node 31A and outputs the Single Graphic Component Signal at node 31B. In this case, the width of the single node wide. In another implementation, the Multiple Component Signal is provided to node 31B while the Single Graphics Component Signal is used by a portion of the system that is not illustrated.

FIG. 2 further illustrates Controller 70 receiving Control Signals from the system of FIG. 1 designated at 25. The control signals specify an aspect or characteristic of the video data as it is being transmitted or displayed. For example, the control signals can include an indication of vertical synchronization, active video, a monitor identifier, color tuning data, shape tuning data, or copy protection data to name a few. The control signal can be in any number of forms including an individual signal, an embedded signal, an analog signal, a digital signal, or an optical signal. The Controller 70 generates Associated Signals as an output to ultimately be provided to the Display Device 50 of FIG. 1, or to a different portion of the system as discussed with reference to the Pixel Component Selector 60. One or more of the Associated Signals can be received by the Pixel Component Selector 60 in order to control generation of the Single Graphic Component Signal.

Figure 3:
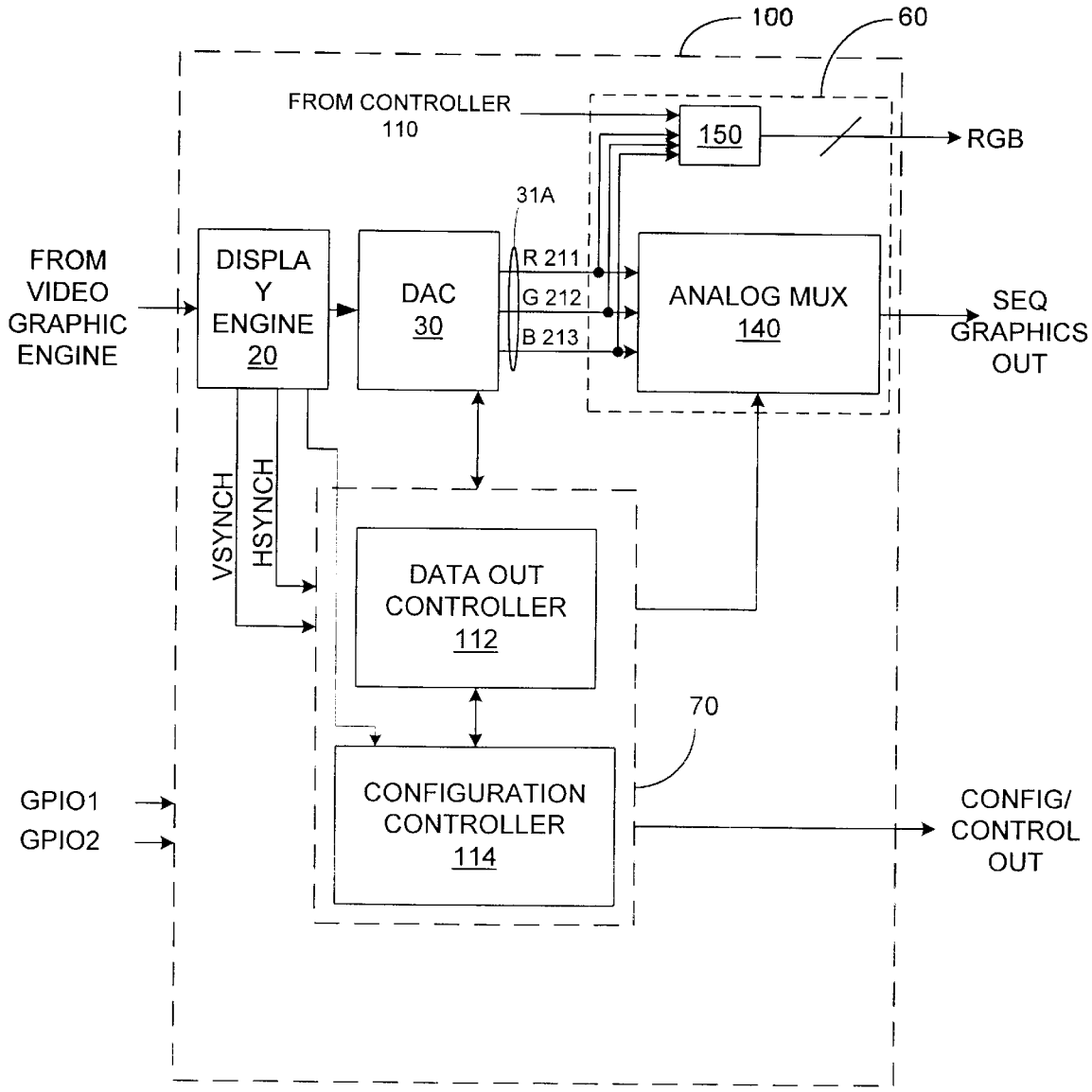
FIG. 3 illustrates, in block diagram form, a portion of a video system that provides a display device with the signals that it needs to display an image.

FIG. 3 illustrates in block diagram form a specific embodiment of the graphics system 100 of FIG. 1. The embodiment incorporates an analog multiplexer 140 and switch 150 as part of the Pixel Component Selector 60, and a Data Out Controller 112 and Configuration Controller 114 as part of the controller 70.

The Display Engine 20 receives data, for example from the frame buffer. The Display Engine 20 is connected to the Controller 70 in order to provide control information. The data from the Display Engine 20 is converted to an analog signal by the DAC 30. The DAC 30 provides red pixel data on node 211, green pixel data on node 212, and blue pixel data on node 213. Note that nodes 211, 212, and 213 are analogous to node 31A of FIG. 1.

Nodes 211 through 213 are connected to the switch 150, and to separate inputs of the analog multiplexer 140, both part of the Pixel Component Selector 60. The switch 150 controls whether RGB pixel components are provided to the Connector 41 of FIG. 1. The Analog Multiplexer 140 selects a sequential video-out signal labeled SEQ GRAPHIC OUT. The Analog Multiplexer 140 and the DAC 30 each receive control signals from the controller 70.

The Controller 70 receives a horizontal synchronization control signal labeled HSYNCH, and a vertical synchronization control signal labeled VSYNCH from the Display Engine 20. In addition, general-purpose I/O lines (GPI01 and GPI02) are connected to the Controller 70 for the purpose of configuring the system 100 for specific modes of operation. The Controller 70 further provides configuration and control output information labeled CONFIG/CONTROL OUT which can be used by a display device such as display device 50 of FIG. 1. The CONFIG/CONTROL OUT data provides control and/or configuration data specifying certain characteristics of the graphics data associated with the SEQ GRAPHIC OUT signal. The CONFIG/CONTROL OUT data will be discussed in greater detail.

In the embodiment of FIG. 3, the Pixel Component Selector 60 is in the position 60B, following DAC 30, as indicated in FIG. 1. By selecting the switch 150 active, the graphics components from the DAC 30 are provided to node 31 B (RGB of FIG. 3) for output at the Connector 41. The Analog Multiplexer 140 of the Pixel Component Selector 60 selects one of the RGB graphics components to be provided at the SEQ GRAPHICS OUTPUT. One advantage of the embodiment of FIG. 3 is that it allows for utilization of existing graphic adapter signals. By reusing existing graphic adapter signals as described, the amount of hardware and software associated with supporting the new signals described herein is minimized.

When the embodiment of FIG. 3 is to drive a traditional RGB display device, the controller 70 will provide appropriate control to the DAC 30 in order to provide the RGB signals 211–213 to the Connector 41 of FIG. 1. When a traditional RGB parallel output is desired, the Display Engine 20 provides the RGB signals at a traditional refresh rate, for example 70 hertz. However, when the Controller 70 is configured to drive a sequential video-out display on the SEQ GRAPHICS OUT node, the DAC 30 provides the RGB signals at a rate approximately three times the standard RGB refresh rate. Therefore, instead of providing the RGB signals at 70 Hertz, the signals are provided at a rate of 210 Hertz by the Display Engine 20 in order to allow each component to be refreshed at an effective 70 hertz rate. The 210 Hertz RGB signals are received by the Analog Multiplexer 140. The Analog Multiplexer 140 has one of the three RGB inputs selected by the Controller 70 in order to be provided as a sequential video-out signal.

The difference between providing sequential video out data and the traditional video technology is that, all the components of a pixel are provided to the display device before the next pixel(s) is provided. In the new technology, the sequential pixel component technology, all the information needed to make up a frame, or portion of a frame, of one pixel component are provided before the next pixel component is provided. It should be understood that a "pixel" can also be a small package of pixels. For example, sometimes YCrCb data is sent in four byte packages containing Y, Cr, Y, Cb, which can make data management easier. Some grouping of pixels may be desirable for pixel packing or data compression reasons. In addition, the portion of the frame being transmitted can include, for example, a line, a "chunk", a sub region of a larger display image (e.g. a window), or multiple frames (for stereoscopic glasses, for example.)

Figure 4:
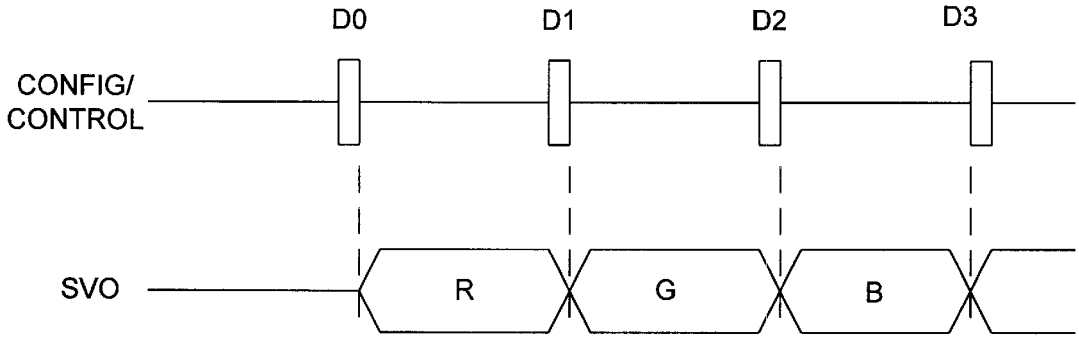
FIG. 4 illustrates, in timing diagram form, data signals associated with the system portion system of FIG. 1.

Synchronizing information is needed in order to synchronize the individual color component signals provided by the Analog Multiplexer 140 to the external display device. The CONFIG/CONTROL OUT signal provides the synchronizing to the display device to indicate which color component the SEQ GRAPHIC OUT signal is providing. FIG. 4 illustrates serial data D0–D3 being provided as CONFIG/CONTROL OUT data just prior to each new color component being transmitted. In this manner, the values of D0–D3 can indicate that the new pixel component is about to be transmitted. For example, the data DO indicates that the red component is about to be transmitted by the sequential graphic-out signal. When the green component is about to be provided, the Dl control information will be transmitted to the display device to indicate green's transmission. Likewise, the D2 and D3 information will be transmitted to indicate the presence of specific color components.

Other types of information which can be transmitted on the configuration/control line includes vertical sync information, horizontal sync information, frame description information, component description information, color correction information (e.g. gamma curve, or display response curve), display device calibration information, signals that provide reference voltages and/or reference time periods, pixel location information, 2-D and 3-D information, transparent frame information, and brightness/control information.

The Controller 70 of FIG. 3 further comprises a data out Controller 112 and a configuration controller 114. The data out Controller 112 is connected to the configuration Controller 114. The controllers 112 and 114 combine to provide control to the Analog Multiplexer 140, and the switch 150. In one embodiment, the data out controller 112 selects the RGB input to be provided as the output of the Analog Multiplexer 140. The Configuration Controller 114 receives data from the general purpose I/Os of the video graphics adapter in order to set any configuration information necessary. For example, the configuration controller can be configured to send specific control parameters specified by specific display devices. By being able to set up specific control parameters needed by display devices, it is possible for the implementation of the present invention to be a generic implementation capable of supporting multiple display devices having different protocols.

The specific embodiment of FIG. 3 illustrates the Pixel Component Selector 60 in the location 60B of FIG. 1. One of ordinary skill in the art will recognize that an implementation similar to that of FIG. 3 can be implemented at any one of locations 60C, or 60D. In addition, an implementation of the Pixel Component Selector 60 that receives data prior to the DAC 30 can also be implemented by routing the outputs of the Pixel Component Selector 60 to one or more DACs, such as DAC 30.

Figure 5:
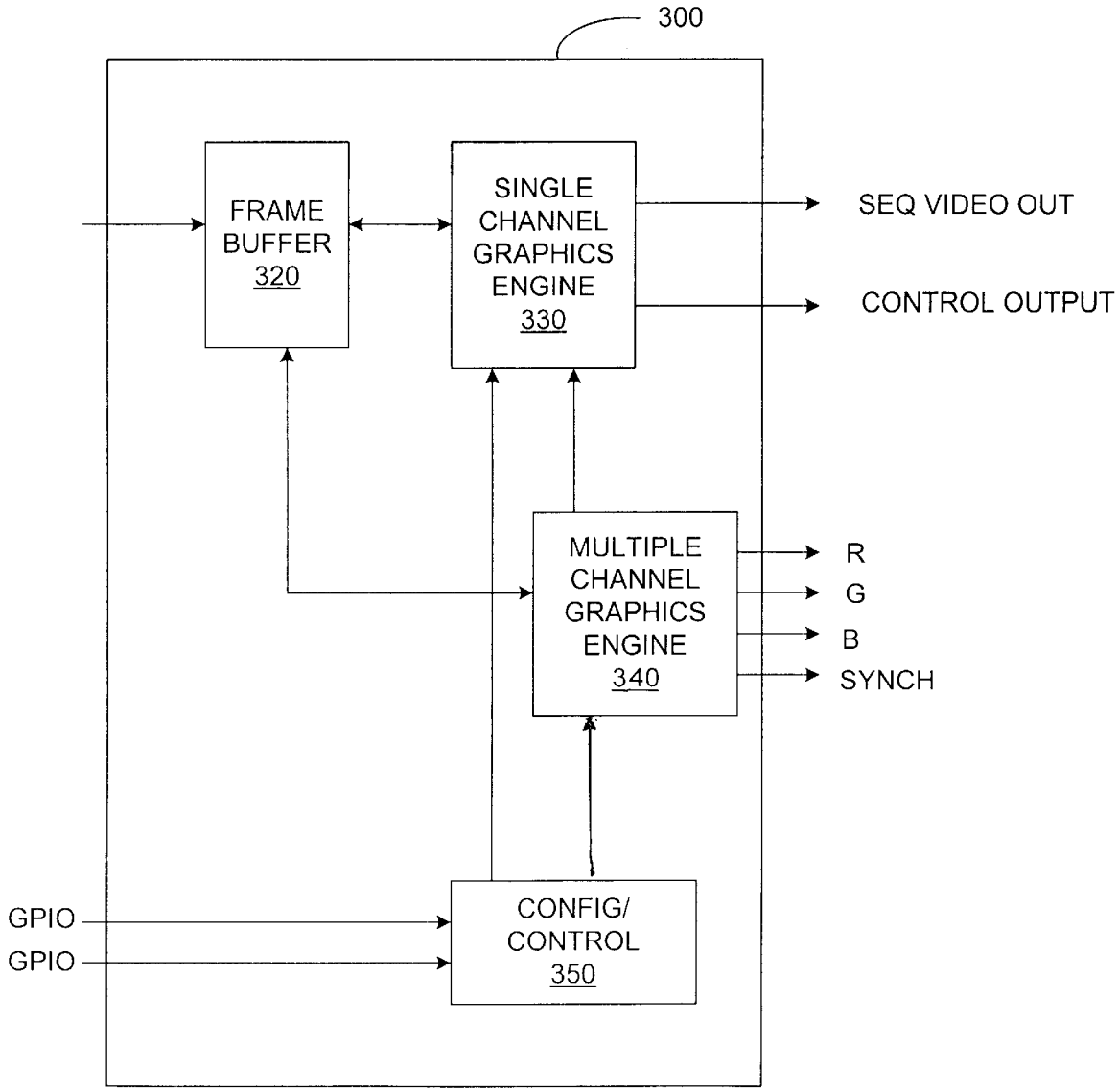
FIG. 5 illustrates, in block diagram form, another embodiment of a video system in accordance with the present invention.

FIG. 5 illustrates another implementation of the present invention. Specifically, the video control portion 300 of FIG. 5 comprises a frame buffer 320 which is analogous to the frame buffer 10 of FIG. 1. The frame buffer 320 is bi-directionally coupled to a Single Channel Graphics Engine 330 and to a Multiple-Channel Graphics Engine 340. A Configuration/Control Portion 350 is connected to both the single channel and multiple-channel graphics engines 330 and 340 to provide a control signal to the display device. Generally, the control signal will provide serialized data. The respective output signals from the single and multiple channel graphics engines 330 and 340 are provided to DACs in the manner discussed previously.

The specific implementation of FIG. 5 allows for either one or both of a parallel RGB or sequential graphic component signal to be generated from the frame buffer 320. For example, a sequential video-output signal may be generated, or both a sequential video-output and a traditional parallel video-output signal can be generated using the implementation of FIG. 5. Dual video generation is accomplished by connecting a frame buffer 320 to two different video-rendering devices. It should be noted however, that multiple frame buffers can be used to support the video channels individually.

The advantage of implementing the channels simultaneously is that it allows multiple display devices to be driven at the same time. The additional overhead associated with simultaneously implementing two video signal drivers is the cost of the digital-to-analog converters associated with the individual video-rendering portion. One of ordinary skill in the art will recognize that other specific implementations of the present invention can be implemented. For example, the functionality of the device of FIG. 3 can be implemented in the device of FIG. 5 by providing appropriate buffering, for example memory ring could be implemented at the switch 150, to compensate for the 3× refresh rate of the single channel graphics engine 330.

In another embodiment, the Display Engine 20 is replaced by a multiple component pixel generator that provides a Composite Television signal: A composite signal has Luma, Chroma, Sync, and Auxiliary information (such as color burst, closed caption data, copy protection signal shaping features) all composited into one analog signal. The Composite signal may even be further composited with an audio signal, modulated, and combined with other signals to create a signal similar to that which is generated by a cable television provider. The Pixel Component Selector 60 in this case will extract timing information by demodulating the combined signal to obtain the Composite signal, and then extract the timing information from the Composite signal. The pixel component data will be extracted by identifying when the luma and chroma were valid, separating them with a comb filter, and further separating the chroma signal into two vectors such as U and V. A selector device associated with the Pixel Component Selector 60 in this case will directly convert the Y, U, and V data into either an R, G, or B component depending on the choice of color conversion coefficients. From the extracted timing information and extracted pixel component, the signaling required to drive a sequential pixel component display would be generated.

Figure 6:
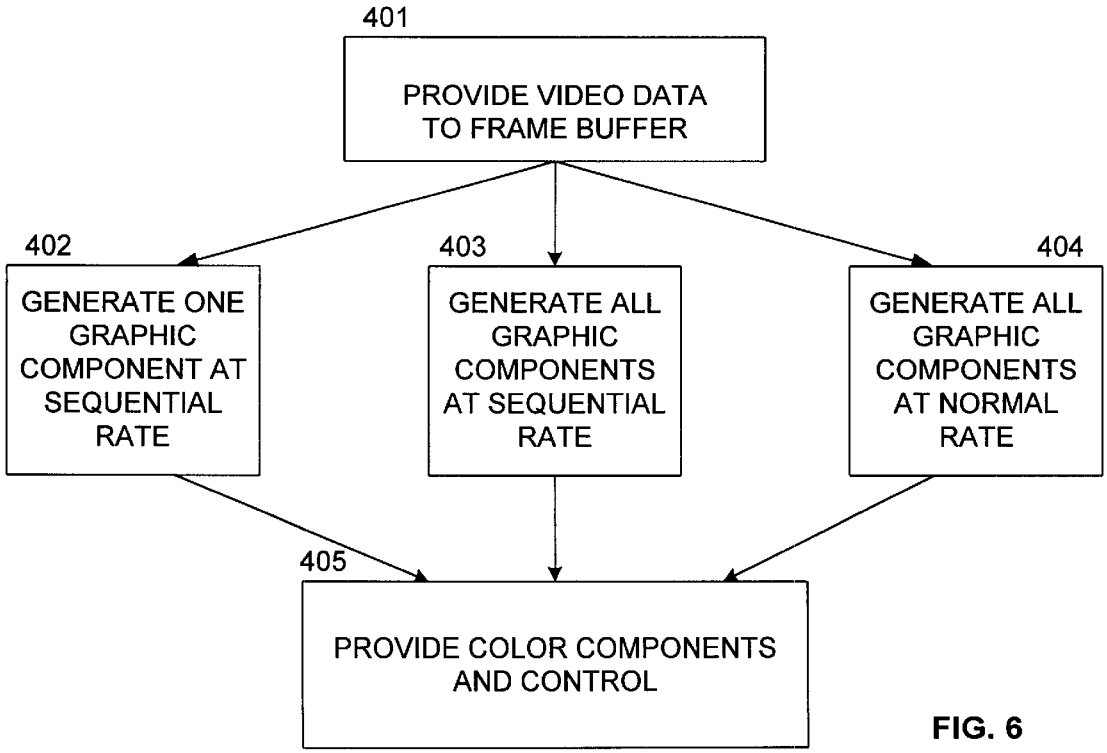
FIG. 6 illustrates, in flow diagram form, a method for implementing the present invention.

FIG. 6 illustrates in flow diagram form a method in accordance with the present invention. At step 401, video data is provided to a frame buffer in a traditional manner. Next, one or a combination of steps 402, 403, or 404 are implemented depending on the specific implementation as previously discussed.

Step 402 renders one pixel components of the video signal. This step is consistent with providing only one graphic component at a time to the SEQ GRAPHIC OUT information. In this implementation, only the graphic component to be rendered would need be accessed in the frame buffer and at a refresh rate capable of supporting a sequential graphics signal.

The second alternative illustrated by step 403 is to render all pixel components at a multiple of the normal refresh rate. This is analogous to the display engine 20 of FIG. 1 generating all of the color components red, green, and blue at three times a standard refresh rate and allowing an analog multiplexer to provide the component information in sequential fashion to the SEQ GRAPHIC OUT port.

The third alternative is illustrated by step 404 where all color components are rendered at a first data rate. This would be analogous to the display engine 20, generating standard RGB signals at nodes 211–213 in order to be provided to the switch 150 to the standard RGB output.

In other implementations, one or two of the steps 402 through 404 can be chosen in order to provide multiple outputs—one for a standard video display device and one for display device requesting sequential data video.

From steps 402–404, the flow proceeds to step 405, where the color components and their associated control information are provided to the display device. As one of ordinary skill in the art will understand, the traditional RGB will provide the synchronization signals necessary to generate the video components, while the synchronous video-output signals will be accompanied by control/configuration information of the type previously discussed with reference to the hardware of FIGS. 1 and 3.

Figure 7:
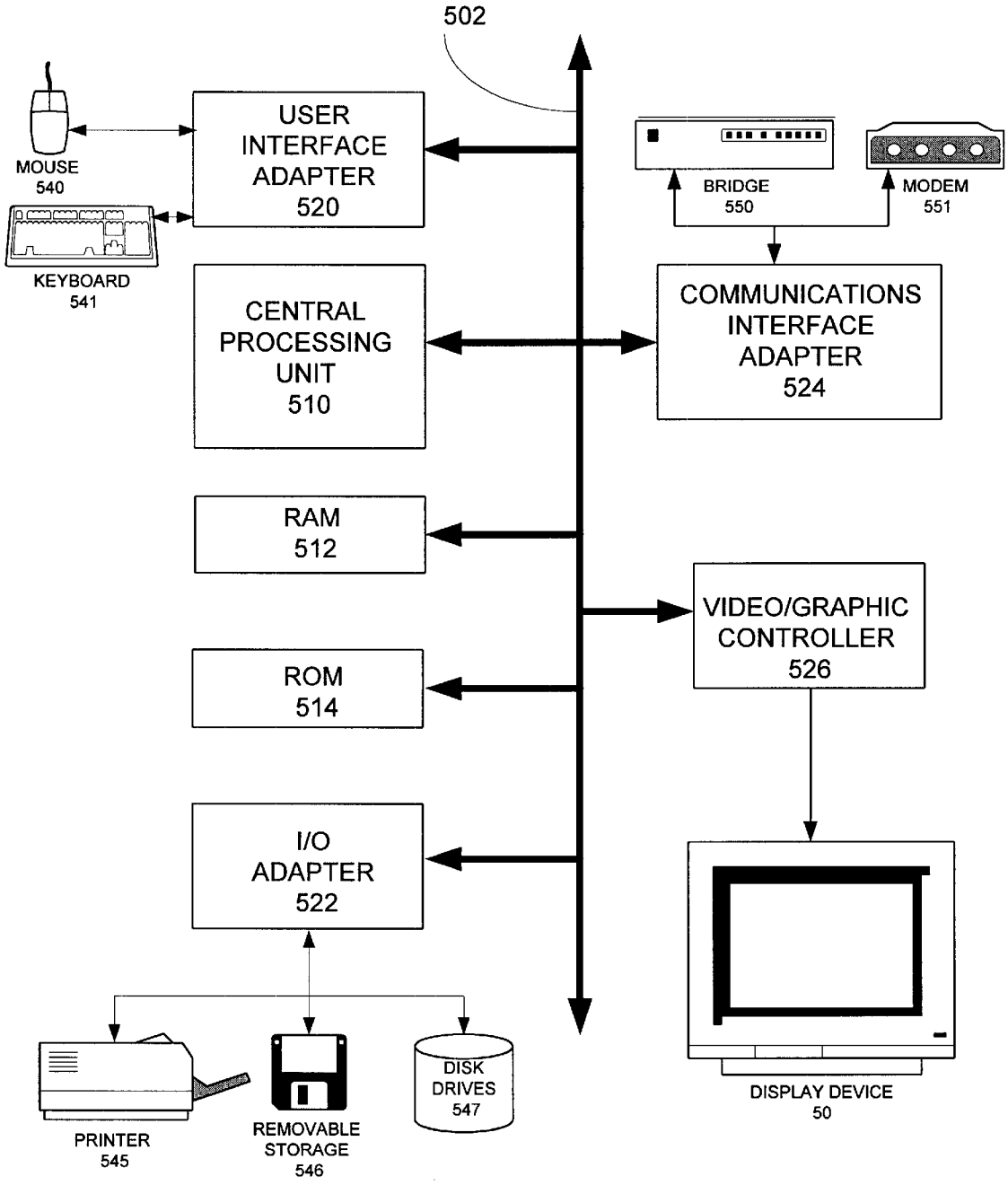
FIG. 7 illustrates, in block diagram form, a system capable of implementing the present invention.

FIG. 7 illustrates a data processing system 500, such as may be used to implement the present invention, and would be used to implement the various methodologies, or incorporate the various hardware disclosed herein.

FIG. 7 illustrates a general purpose computer that includes a central processing unit (CPU) 510, which may be a conventional or proprietary data processor, and a number of other units interconnected via system bus 502.

The other portions of the general purpose computer include random access memory (RAM) 512, read-only memory (ROM) 514, and input/output (I/O) adapter 522 for connecting peripheral devices, a user interface adapter 520 for connecting user interface devices, a communication adapter 524 for connecting the system 500 to a data processing network, and a video/graphic controller for displaying video and graphic information.

The I/O adapter 522 is further connected to disk drives 547, printers 545, removable storage devices 546, and tape units (not shown) to bus 502. Other storage devices may also be interface to the bus 512 through the I/O adapter 522.

The user interface adapter 520 is connected to a keyboard device 541 and a mouse 541. Other user interface devices such as a touch screen device (not shown) may also be coupled to the system bus 502 through the user interface adapter 520.

A communication adapter 524 connected to bridge 550 and/or modem 551. Furthermore, a video/graphic controller 526 connects the system bus 502 to a display device 560 which may receive either parallel or sequential video signals. In one embodiment, the system portions 100 and/or 300 herein are implemented as part of the VGA controller 526.

It should be further understood that specific steps or functions put forth herein may actually be implemented in hardware and/or in software. For example, controller 70 which provides the CONFIG/CONTROL OUT signal can be performed by hardware engine of a graphics controller, by a programmable device using existing signals, or in firmware, such as in microcode, executed on the processing engine associated with a VGA.

It should be apparent that the present invention provides for a flexible method of providing two types of video data to display devices. In addition, the two types of display information are provided without making significant changes to the existing protocols of the standard RGB signals. Therefore, the present invention allows for multiple type display devices to be utilized without increasing the overall cost of the system significantly.

The present invention has been illustrated in terms and specific embodiments. One skilled in the art will recognize that many variations of the specific embodiments could be implemented in order to perform the intent of the present invention. For example, the analog multiplexer 140, can be replaced with a digital multiplexer that receives digital values representing the pixel color components. The selected digital value can be provided to a digital to analog converter (DAC) in order to provide the desired sequential signal.

We claim:

1. A video system comprising:

a first node to receive a first video component;

a second node to receive a second video component;

a third node to receive a third video component; and a storage element to store a value indicating one of a plurality of states;

a first video driver having a first input coupled to the first node, a second input coupled to the second node, a third input coupled to the third node, a fourth input coupled to the storage element, and an output node coupled to the first, second and third input, wherein the output node is to provide a representation of the first, second, and third video components sequentially when the value is in a first state; and a second video driver having a select input coupled to the storage element, a first input coupled to the first node, a second input coupled to the second node, a third input coupled to the third node, a fourth input coupled to the storage element, a first output coupled to the first input to provide a representation of the first video component, a second output coupled to the second input to provide a representation of the second video component, a third output coupled to the third input provide a representation of the third video component, wherein the first, second and third outputs are to provide data simultaneously when the value is in a second state.

2. The system of claim 1, wherein the first video driver further comprises an analog multiplexer coupled to the first, second, and third input node.

3. The system of claim 1 further comprising:

a fifth node to receive a synchronization indicator;

a controller having an input coupled to the fifth node, and having an output to provide a serial data representation of a vertical and horizontal synchronization indicator.

4. The system of claim 3, wherein the first video driver is to provide the representation of the first, second, and third video components sequentially when the value is in a third state; and the second video driver provides data simultaneously to the first, second, and third outputs when the value is in the third state.

5. A method of providing video data, the method comprising:

providing a first, second, and third video component simultaneously to a first display; and providing the first, second and third video component sequentially to a second display.

6. The method of claim 5 further comprising the steps of:

simultaneously receiving the first, second, and third video component and displaying the first, second and third video component substantially simultaneously; and sequentially receiving the first, second, and third video component and displaying the first, second and third video component substantially independent of each other.

7. A video system comprising:

a first node to receive a first video component;

a second node to receive a second video component;

a third node to receive a third video component; and a storage element to store a value indicating one of a plurality of states;

a first video driver having a first input coupled to the first node, a second input coupled to the second node, a third input coupled to the third node, a fourth input coupled to the storage element, and an output node coupled to the first, second and third input, wherein the output node is to provide a representation of the first, second, and third video components sequentially when the value is in a first state;

a second video driver having a select input coupled to the storage element, a first input coupled to the first node, a second input coupled to the second node, a third input coupled to the third node, a fourth input coupled to the storage element, a first output coupled to the first input to provide a representation of the first video component, a second output coupled to the second input to provide a representation of the second video component, a third output coupled to the third input provide a representation of the third video component, wherein the first, second and third outputs are to provide data simultaneously when the value is in a second state and the second driver provides data simultaneously to the first, second, and third outputs when the value is a third state;

a fifth node to receive a synchronization indicator; and a controller having an input coupled to the fifth node, and having an output to provide a serial data representation of a vertical and horizontal synchronization indicator.

8. A method of providing video data, the method comprising:

receiving a first video color component;

receiving a second video color component;

receiving a third video color component;

receiving a synchronization signal;

receiving a variable;

providing a the first, second, and third video components sequentially on a fourth output, and a serial synchronization indicator on a fifth output when the variable is in a first state, wherein the serial synchronization indicator is representative a vertical and horizontal synchronization indicator;

providing the first, second, and third video color components simultaneously on first, second, and third outputs when the variable is in a second state;

providing the first, second, and third video color components sequentially on the fourth output when the variable is in a third state; and providing the first, second, and third video components simultaneously on the first, second, and third outputs when the variable is in the third state.

9. A method of providing video data, the method comprising:

receiving a first video color component representing a plurality of pixels that are associated with a frame of video;

receiving a second video color component;

receiving a third video color component;

receiving a synchronization signal;

receiving a variable;

providing a the first, second, and third video components sequentially on a fourth output, and a serial synchronization indicator on a fifth output when the variable is in a first state, wherein the serial synchronization indicator is representative a vertical and horizontal synchronization indicator;

providing the first, second, and third video color components simultaneously on first, second, and third outputs when the variable is in a second state;

providing the first, second, and third video color components sequentially on the fourth output when the variable is in a third state; and providing the first, second, and third video components simultaneously on the first, second, and third outputs when the variable is in the third state.

10. A graphics system comprising:

a multiple component pixel generator to provide a plurality of graphics components to be displayed simultaneously;

a signal generator to provide at least one signal associated with the plurality of graphics components;

a pixel component selector to receive the plurality of graphics components, and to provide one of the graphics components;

an associated signal generator to receive the at least one signal, and to provide a graphics control output based on the at least one signal; and a storage location to store a value indicating a selection criteria; wherein the pixel component selector provides the graphics control output based at least partially on the value.

11. A method of providing video data, the method comprising:

receiving a first video color component;

receiving a second video color component;

receiving a third video color component;

receiving a synchronization signal;

receiving a variable;

providing the first, second, and third video components sequentially on a fourth output, and a serial synchronization indicator on a fifth output when the variable is in a first state, wherein the serial synchronization indicator is representative of a vertical and horizontal synchronization indicator; and providing the first, second, and third video color components simultaneously on a first, second and third output when the variable is in a second state.

12. The method of claim 11, further comprising the steps of providing a first, second, and third video color components sequentially on the fourth output when the variable is in a third state; and providing the first, second, and third video components simultaneously on the first, second and third output when the variable is in the third state.

13. A method of providing video data, the method comprising:

receiving a first video color component;

receiving a second video color component;

receiving a third video color component;

receiving a synchronization signal;

receiving a variable;

providing the first, second, and third video components sequentially on a fourth output, and a serial synchronization indicator on a fifth output when the variable is in a first state, wherein the serial synchronization indicator is representative of a vertical and horizontal synchronization indicator; and the first video color component represents a plurality of pixels having a common color.

14. The method of claim 13, wherein the plurality of pixels include pixels from a plurality of rows and a plurality of columns.

15. The method of claim 13, wherein the plurality of pixels include all pixels from at least one row.

16. The method of claim 13, wherein the plurality of pixels include all pixels from at least one column.

17. The method of claim 13, wherein the plurality of pixels associated with a frame of video.

18. A method of providing video data, the method comprising:

receiving a first video color component;

receiving a second video color component;

receiving a third video color component;

receiving a synchronization signal;

receiving a variable;

providing the first, second, and third video components sequentially on a fourth output, and a serial synchronization indicator on a fifth output when the variable is in a first state, wherein the serial synchronization indicator is representative of a vertical and horizontal synchronization indicator; and the second video color component represents a plurality of pixels having a second common color.

19. A method of providing video data, the method comprising:

receiving a first video color component;

receiving a second video color component;

receiving a third video color component;

receiving a synchronization signal;

receiving a variable;

providing the first, second, and third video components sequentially on a fourth output, and a serial synchronization indicator on a fifth output when the variable is in a first state, wherein the serial synchronization indicator is representative of a vertical and horizontal synchronization indicator; and the third video color component represents a plurality of pixels having a third common color.

20. A method of providing video data, the method comprising:

receiving a first video color component;

receiving a second video color component;

receiving a third video color component;

receiving a synchronization signal;

receiving a variable;

providing the first, second, and third video components sequentially on a fourth output, and a serial synchronization indicator on a fifth output when the variable is in a first state, wherein the serial synchronization indicator is representative of a vertical and horizontal synchronization indicator; and further comprising the steps of receiving include the substeps of first generating the first, second, and third color video component.

21. A graphics system comprising:

a multiple component pixel generator to provide a plurality of graphics components to be displayed simultaneously;

a signal generator to provide at least one signal associated with the plurality of graphics components;

a pixel component selector to receive the plurality of graphics components, and to provide one of the graphics components;

an associated signal generator to receive the at least one signal, and to provide a graphics control output based on the at least one signal; and the plurality of graphics components includes a red, a luma and a chroma graphics component.

22. The system of claim 21, wherein the plurality of graphics components are part of a composite video signal.

23. The system of claim 21, wherein the graphics control output to be provided by the associated signal generator includes providing a vertical and horizontal synchronization indicator on a common node.

24. A graphics system comprising:

a multiple component pixel generator to provide a plurality of graphics components to be displayed simultaneously;

a signal generator to provide at least one signal associated with the plurality of graphics components;

a pixel component selector to receive the plurality of graphics components, and to provide one of the graphics components;

an associated signal generator to receive the at least one signal, and to provide a graphics control output based on the at least one signal; and a storage location to store a value indicating a selection criteria; wherein the pixel component selector provides the graphics control output based at least partially on the value.

25. The system of claim 24, wherein the pixel component selector includes an analog multiplexor.

26. The system of claim 24, wherein the pixel component selector includes a digital multiplexor.

* * * * *